US006832497B1

(12) United States Patent
Rock et al.

(10) Patent No.: US 6,832,497 B1
(45) Date of Patent: Dec. 21, 2004

(54) KNIT FABRICS WITH CONTRASTING FACE AND BACK

(75) Inventors: Moshe Rock, Brookline, MA (US); Gadalia Vainer, Melrose, MA (US); Charles Haryslak, Marlborough, MA (US)

(73) Assignee: Malden Mills Industries, Inc., Lawrence, MA (US)

( * ) Notice: Subject to any disclaimer, the term of this patent is extended or adjusted under 35 U.S.C. 154(b) by 0 days.

(21) Appl. No.: 10/823,812

(22) Filed: Apr. 13, 2004

(51) Int. Cl.[7] ..... D04B 21/00
(52) U.S. Cl. ..... 66/195
(58) Field of Search ..... 66/195, 194, 196; 442/304, 318

(56) References Cited

U.S. PATENT DOCUMENTS 3,921,418 A * 11/1975 Apken ..... 66/87
4,302,953 A * 12/1981 Wilkens ..... 66/87
4,315,419 A * 2/1982 Kernbichler et al. ..... 66/87
4,712,281 A * 12/1987 Scheller ..... 28/162
5,855,125 A * 1/1999 Lohmueller et al. ..... 66/196
6,196,032 B1 3/2001 Rock et al.
6,199,410 B1 3/2001 Rock et al.

* cited by examiner

*Primary Examiner*—Danny Worrell
(74) *Attorney, Agent, or Firm*—Fish & Richardson P.C.

(57) ABSTRACT

A fabric is formed by cooperatively knitting together a plurality of backing or stitch yarns and pile yarns to define a technical face with a velour surface and a first set of appearance characteristics and a technical back with a velvet face and a second set of appearance characteristics, the first set of appearance characteristics contrasting to the second set of appearance characteristics. A method of forming the fabric is also described.

33 Claims, 6 Drawing Sheets

KNIT FABRICS WITH CONTRASTING FACE AND BACK

TECHNICAL FIELD

This invention relates to knit fabrics having contrasting appearance between the technical face and the technical back.

BACKGROUND

Nappable knit fabrics have been made on double needle bar knitting machines using five to eight yarn guide bars for simultaneously knitting two fabric layers joined by interconnecting pile yarns. After knitting, the fabric layers may be separated by cutting the interconnecting pile yarns. In some knitting processes, the pile yarns are carried by the middle or inner bars (for example, bars three, four and five on a seven bar arrangement) and tie the two fabric layers together, with the pile yarns disposed on the technical back of each fabric. In such fabrics, the pile yarns are employed to provide the fabric with a particular characteristic and aesthetic value such as pattern, softness, luster, hand, resiliency, fullness, bulk and warmth. The pile yarns generally do not contribute to the dimensional stability and strength of the fabric; rather, the backing and stitch yarns, which are generally thinner and less bulky than the pile yarns on the middle bars, provide structural characteristics, e.g., by holding the fabric together and providing dimensional stability. In such fabrics, the technical face of each fabric layer is not nappable by itself, but napping can be achieved by pulling pile yarn from the technical back, resulting in a velour finish on the technical face with the same pattern and composition as the velvet finish on the technical back.

In other knit fabrics, e.g. as described in U.S. Pat. Nos. 6,196,032 and 6,199,410, the complete disclosures of which are incorporated herein by reference, the backing or stitch yarns are relatively heavier than in the fabric layers described above, and they cover the pile yarns at the technical face, so the backing or stitch yarns can be napped to provide fibers for the velour finish on the technical face. As a result, the technical face can have a pattern, e.g. of shapes and/or color, different from a pattern of shapes and/or color on the technical back.

SUMMARY

The inventor has found that fabrics having particularly desirable aesthetic properties can be produced, using the methods described in U.S. Pat. Nos. 6,196,032 and 6,199,410, by selecting the pile yarns and the backing or stitch yarns to provide a contrasting appearance between the technical face and technical back of the fabric. For example, the technical face and technical back may exhibit different depths of color. The contrasting appearance is provided by the selection of contrasting yarns for the pile and for the backing/stitch yarns. The contrasting yarns may exhibit, for example, physical differences, e.g., after heating during the dyeing process, and color differences, e.g., due to differences in the amount of dye taken up by the respective yarns. The fabric structure described in U.S. Pat. No. 6,196,032 is utilized to keep the pile yarns to the technical back and the backing/stitch yarns to the technical face and thereby to create the contrast between the opposite surfaces of the fabric.

In one aspect, the invention features a method of making a fabric on a double bar knitting machine, with the fabric having a technical face with a velour surface and a first set of appearance characteristics, and the fabric having an opposite, technical back with a velvet surface and a second set of appearance characteristics, the first set of appearance characteristics of the technical face contrasting to the second set of appearance characteristics of the technical back. The method includes: (a) selecting backing or stitch yarns and selecting pile yarns to provide the fabric with the technical face having the first set of appearance characteristics and the technical back having the contrasting second set of appearance characteristics; (b) knitting a three-dimensional fabric structure on the knitting machine, the structure having two fabric substrates formed from the backing and stitch yarns, each defining a technical face and a technical back, and a plurality of the pile yarns extending between and interconnecting the fabric substrates; (c) during knitting, causing the backing yarns or the stitch yarns to cover the pile yarns at the technical face of each fabric substrate; (d) cutting the pile yarns to separate the fabric substrates, with ends of the pile yarns extending from the technical back of each fabric substrate; (e) dyeing the fabric substrate; (f) processing the backing yarns or the stitch yarns covering the pile yarns at the technical face of the fabric substrate to form the velour surface; and (g) processing the pile yarns at the technical back of the fabric substrate to form the velvet surface. The first and second sets of appearance characteristics are each selected from among: depth of color upon dyeing, degree of raising, degree of air permeability, susceptibility to selected dye formulation, reaction to heat, and degree of coarseness, bulk and/or denier.

Some implementations may include one or more of the following feature. The step of dyeing the fabric may include dyeing to a solid color, and the step of selecting the yarns may include selecting the yarns to have different dyeabilities and/or dye uptakes. The step of dyeing the fabric may include dyeing the backing yarns or stitch yarns exposed at the technical face to have a first base color and a first depth of color and dyeing the pile yarns exposed at the technical back to have a first base color and a second depth of color, the first depth of color being in contrast to the second depth of color. The step of selecting the first set of appearance characteristics and selecting the contrasting second set of appearance characteristics may include selecting the depth of color upon dyeing, with the first depth of color selected to be relatively lighter than the second depth of color. The step of selecting the first set of appearance characteristic and selecting the contrasting second set of appearance characteristics may include selecting the depth of color upon dyeing, with the first depth of color selected to be relatively darker than the second depth of color. The step of selecting the first set of appearance characteristics and selecting the contrasting second set of appearance characteristics may include selecting a first dye for the backing or stitch yarns and selecting a second, different dye for the pile yarns. The step of selecting the first set of appearance characteristics and selecting the contrasting second set of appearance characteristics may include selecting a first material for the backing or stitch yarns and selecting a second material for the pile yarns. The step of selecting the backing or stitch yarns and selecting the pile yarns may include selecting the first material and the second material to be 100% polyester. The step of selecting the pile yarns may include selecting first pile yarns having first appearance characteristics and selecting second pile yarns having second appearance characteristics different from the first appearance characteristics. The step of knitting may include disposing the pile yarns in a predetermined pattern comprising one or more regions of the first pile yarns having the first appearance characteristics and one or more regions of the second pile yarns having the second appearance characteristics different from the first appearance characteristics. The step of processing the pile yarns may include causing the velvet surface to have a depth in the range of about 2/32-inch to about 18/32-inch. The method may further one or more of the following steps: dyeing one or more regions of the backing or stitch yarns at the technical face through by application of dye of contrasting color by wet printing techniques; applying a chemical binder upon one or more regions of the backing or stitch yarns at the technical face to create regions of enhanced surface abrasion resistance; and applying a chemical resist upon one or more regions of the backing or stitch yarns of the technical face prior to the step of processing, for local resistance to napping and raising, thereby to create a predetermined pattern of regions of low or no fleece among adjacent regions of high fleece in the velour surface of the technical face.

In another aspect, the invention features a fabric including a plurality of backing or stitch yarns cooperatively knitted together and thereby defining a technical face with a velour surface and a first set of appearance characteristics, and a technical back with a velvet face and a second set of appearance characteristics, the first set of appearance characteristics contrasting with the second set of appearance characteristics. The fabric also includes a plurality of pile yarns extending from the technical back and being napped or raised, thereby forming the velvet surface at the technical back, the backing or stitch yarns covering the technical face and being napped or raised, thereby forming the velour surface at the technical face. The backing or stitch yarns cover the pile yarns in a manner such that only the backing or stitch yarns are raised along the technical face, and are formed of materials having the first set of appearance characteristics selected from the group of appearance characteristics consisting of: depth of color upon dyeing, degree of raising, degree of air permeability, susceptibility to selected dye formulation, reaction to heat, and degree of coarseness, bulk and/or denier. The pile yarns are formed of materials having the second set of appearance characteristics selected from among the group of appearance characteristics consisting of: depth of color upon dyeing, degree of fiber straightness, degree of fiber curl, degree of fiber shrinkage, degree of fiber crimp degree of raising, reaction to heat, degree of yarn coarseness, bulk and/or denier.

Some implementations include one or more of the following features. The backing or stitch yarns may have a first cross-section and the pile yarns may have a second, different cross-section. The pile yarns may have a cross-section selected from the group consisting of serrated ribbon and trilobal. The backing or stitch yarns may have a first denier and the pile yarns have a second, different denier. The technical back and the technical face may be of the same hue. The technical back and the technical face may have contrasting surface textures. For example, the technical back may have a raised pile surface and the technical face may have a sheared chamois or suede surface. The velvet surface of the technical back and the velour surface of the technical face may have contrasting pile heights. For example, the velvet surface may have a pile height in the range of about 0.06 inch to about 0.6 inch, and the velour surface may have a significantly lower pile height. The backing or stitch yarns may include microdenier yarns. The fabric may be jet-dyed. The pile yarns, backing yarns and/or stitch yarns may include polyester, e.g., they may be 100% polyester yarns. One or more regions of the velour surface may have a color contrasting to a surrounding region by application of dye by wet printing techniques. One or more regions of the backing or stitch yarns at the technical face have enhanced surface abrasion resistance by application of chemical binder. The technical face may define a predetermined pattern of regions of low or no fleece among adjacent regions of high fleece in the velour surface, achieved by application of a chemical resist upon regions of the backing or stitch yarns of the technical face prior to processing, for local resistance to napping and raising.

In some implementations, the fabrics exhibit one or more of the following advantages. The technical face may have a high cover factor and very fine denier, and thus exhibit good wind resistance. The technical face may provide low air permeability. The technical back may include a raised surface that is configured to provide a high level of thermal insulation to reduce convective heat loss. For example, the technical back may have a high pile height, e.g., in the range of 0.06 inch to 0.6 inch.

The details of one or more embodiments of the invention are set forth in the accompanying drawings and the description below. Other features and advantages of the invention will be apparent from the description and drawings, and from the claims.

DESCRIPTION OF DRAWINGS

Like reference symbols in the various drawings indicate like elements.

DETAILED DESCRIPTION

Preferred fabrics of the invention are knitted using the knitting methods described in U.S. Pat. Nos. 6,196,032 and 6,199,410.

Figure 1B:
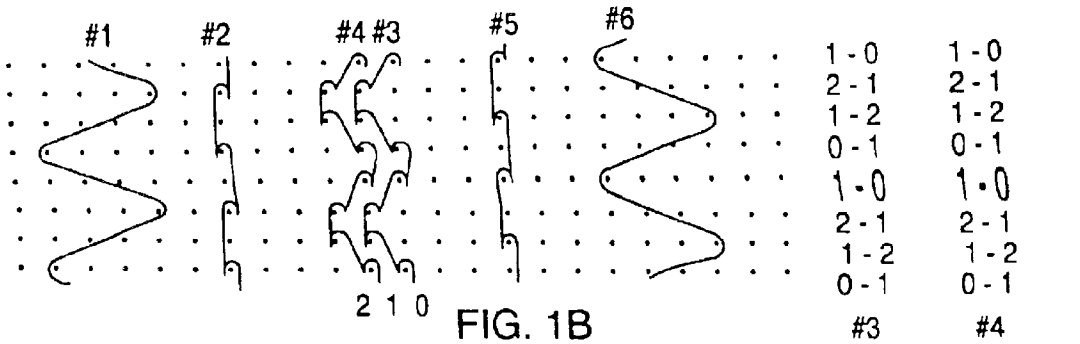
FIG. 1B PRIOR ART
FIGS. 1*a* and 1*b* show a lap diagram for knitting prior art fabrics.
Figure 1A:
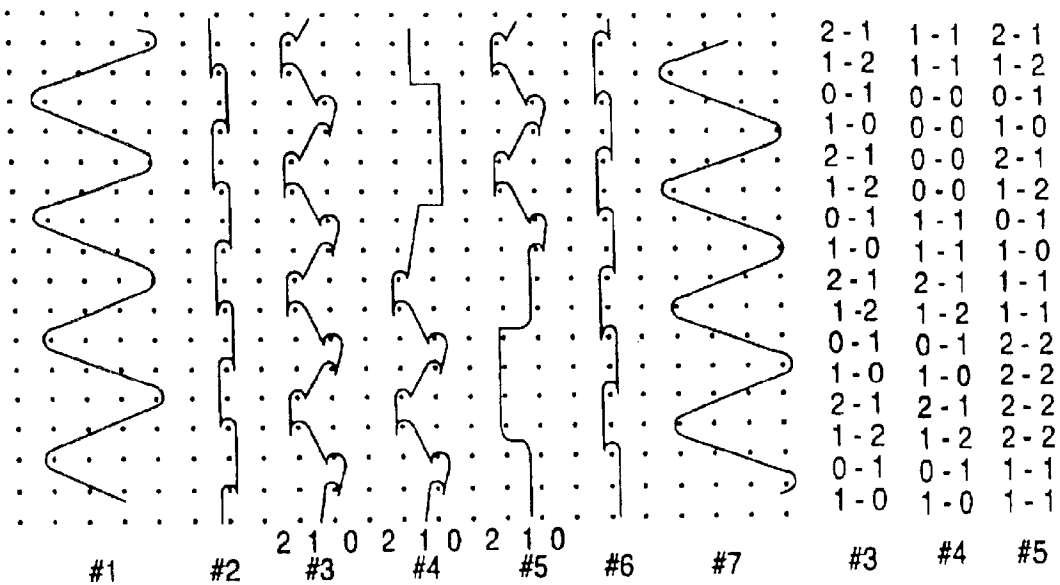
FIG. 1A PRIOR ART

FIG. 1A shows a standard pattern diagram for a prior art seven guide bar double needle bar Raschel machine. As discussed above, in this arrangement, guide bars 1,2 and 6,7 form the front and back support substrates respectively while guide bars 3, 4 and 5 reciprocate between the support substrates to generate the pile yarns.

Figure 4:
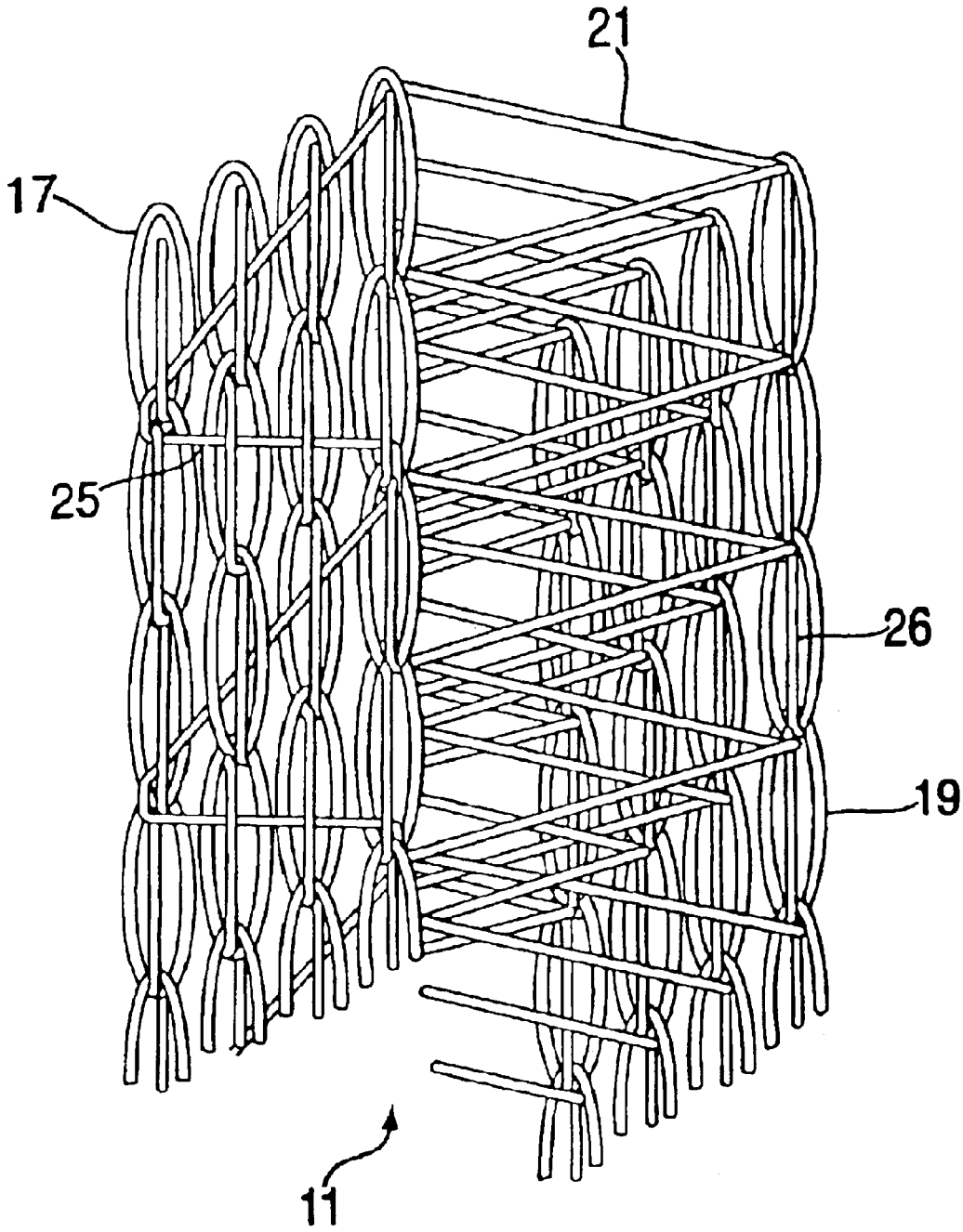
FIG. 4 shows a cross-sectional view of a three-dimensional fabric structure prior to cutting.
Figure 5:
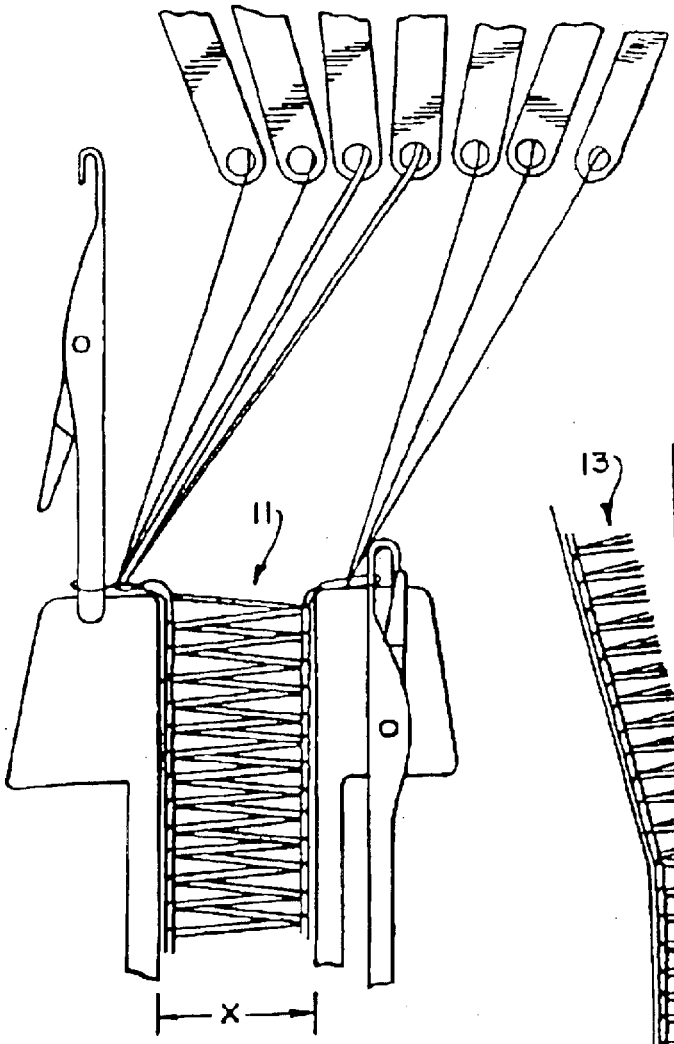
FIG. 5 is a side view of a double needle bar Raschel machine knitting a three-dimensional fabric.
Figure 6:
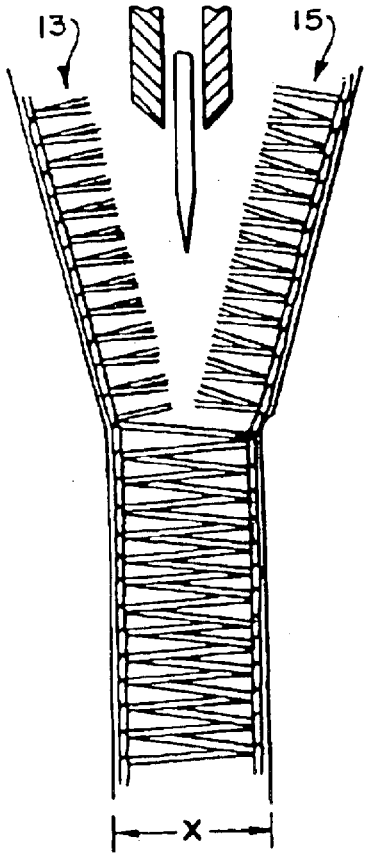
FIG. 6 is a side view in which the three-dimensional fabric of FIG. 3 is split into two fabrics.

The yarns for end bars 1, 2, 6 and 7 are thinner and less bulky then the pile yarns. The yarns on end bars 1 and 7 are backing yarns 25, 26 and the yarns on end bars 2 and 6 are stitch yarns 17, 19. Because yarns 25 and 26 on end bars 1 and 7 are thinner and less bulky than the pile yarns on the middle bars 3, 4 and 5, they are covered by the pile yarns and are not nappable. A three-dimensional structure 11, knitted using this arrangement (see FIG. 4), is slit by cutting the pile yarns 21 into two fabrics, each having a face and a back. The back with the pile yarns is brushed to form plush velvet. The face is left flat and smooth.

A prior art machine similar to that shown in FIG. 1A but with only six guide bars is shown in FIG. 1B. In this case, guide bars 1, 2, 5 and 6 are end bars carrying the backing and stitch yarns and only guide bars 3 and 4 carry pile yarns.

The present invention, in contrast, provides a different arrangement. First, the backing yarns for bars 1 and 7 are made from the same type of yarns, in quality, bulk and thickness, as the pile yarns for intermediate guide bars 3, 4 and 5. In this manner, contrary to the prior art, the backing yarns on guide bars 1 and 7 are not hidden, but are exposed on the technical face. Therefore, when the face is napped, the fibers forming the resulting fleece/velour are from the fibers of these backing yarns, and form a predetermined pattern on the velour, which is different from any pattern on the velvet. Moreover, the backing yarns now cover the pile yarn pattern so that none of the pile yarn pattern is pulled from the back to the face.

Figure 2:
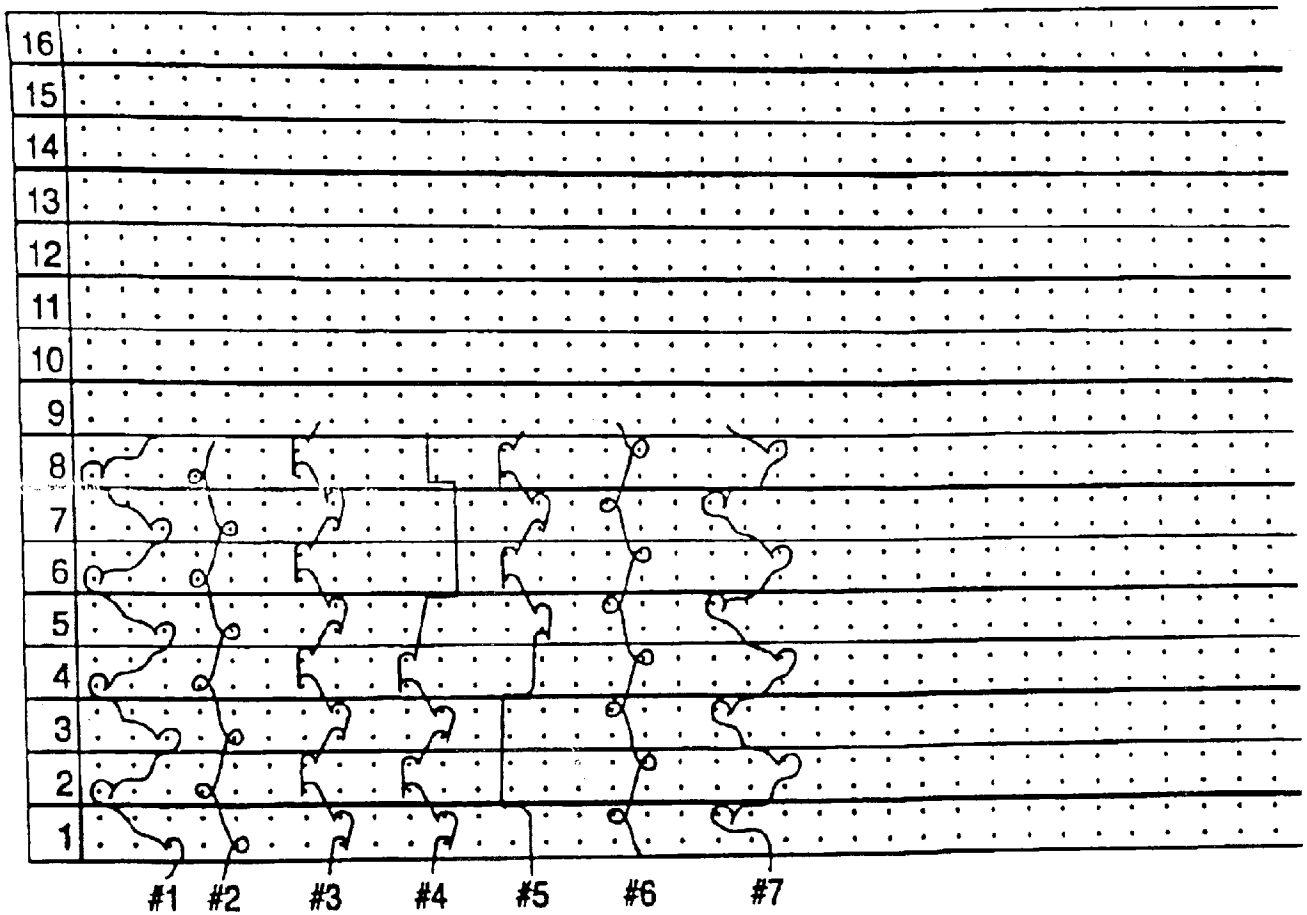
FIG. 2 PRIOR ART
FIG. 2 shows a prior art lap diagram for constructing a three-dimensional knit fabric of two fabric layers joined by interconnecting yarns.

Second, the movement of the backing yarn guide bars is changed. As shown in FIG. 2, the movement of bars 1 and 7 is changed from a four-needle underlap (shown in FIG. 1) to an open 2- and -1 lapping movement. Moreover, the movement of yarn guide bars 2 and 6 is changed from an open lap pillar stitch, normally used, to a closed 1- and -1 lapping movement. This change in guide bar movement ensures that the resulting fabric retains its strength and stability in both the warp and filling direction after the napping step. Moreover, the stitch yarns of yarn guide bars 2 and 6 remain hidden. They are, therefore, not touched by the napper wires during subsequent napping.

The arrangement shown in FIG. 2 is just one example of an arrangement that can be used to obtain a fabric with a velvet finish with a pattern on one side and a velour finish with a pattern on the other side. Further, the fabric can be made either more elastic or more dimensionally stable as desired by increasing or decreasing lap movement of guide bars 1, 2, 6 and 7.

Figure 3:
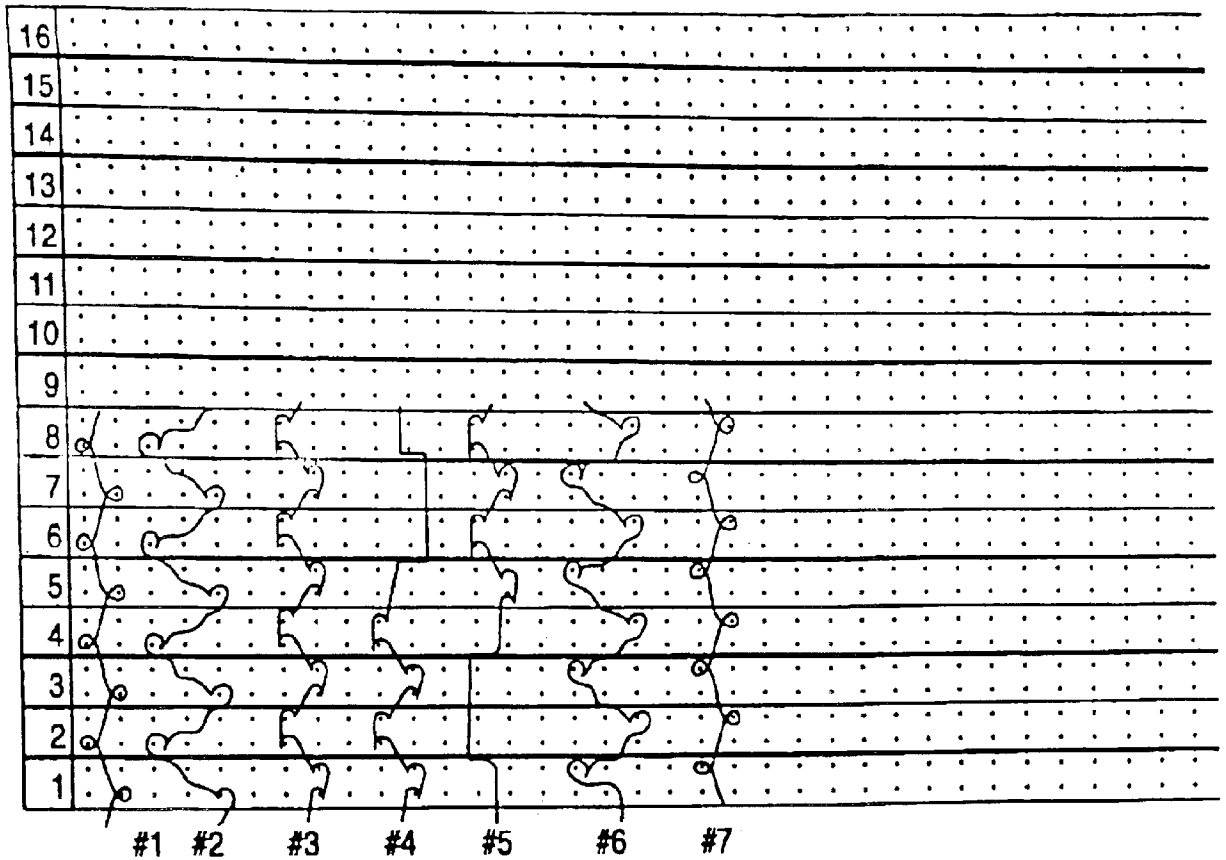
FIG. 3 PRIOR ART
FIG. 3 shows a prior art lap diagram for a second embodiment of a three-dimensional knit fabric.

Alternatively, the bulk and quality of the stitch yarns can be increased so that they are nappable, while the backing yarns remain thin and hidden, as in the prior art. In this embodiment, velour is formed on the face, which includes fibers from the stitch yarns. In addition, the backing yarns are hidden from the napper wires during the napping step. For this embodiment, the movement of the backing guides 1 and 7 and stitch guides 2 and 6 are interchanged as shown in FIG. 3, as compared to the arrangement shown in FIG. 2.

A large variety of yarns can be used to make the subject fabric. For example, polyester yarns can be used to make the velour. In addition, the yarns could be made of nylon, acrylic or polypropylene. In addition, combination yarns may also be used. For example, a polyester yarn may be used for the pile yarns, resulting in a polyester velvet on the back, while a cotton or wool yarn may be used for the remaining yarns resulting in a cotton or wool velour on the face.

Preferably a multifilament yarn with a yarn count in the range of 50 to 250 denier is used for the support substrates (for the stitch and backing yarns). The pile yarns forming the velvet can be spun or multifilament of 0.5 to 5 dpf and generally they are about 1.5–3.5 times heavier than the thinner yarns of the support fabric. Therefore, the pile yarns yield plush velvet. Moreover, if the pile yarns are thinner than the backing yarns, the likelihood that they are pulled through the support substrate to the technical face is reduced.

The yarns to be napped (i.e., the backing yarn of FIG. 2 or the stitch yarn of FIG. 3) in order to produce the velour are preferably of a weight in the same range as the pile yarns. The heavier this yarn, the more velour is generated during napping of the technical face.

Selection of the pile yarns determines the appearance of the technical back, while selection of the backing or stitch yarns (depending on which is available for napping, as discussed above) determines the appearance of the technical face. The pile yarn and the nappable backing or stitch yarn differ in a manner to produce distinctly different, contrasting effects between the technical face and technical back. Importantly, the pile yarns are not exposed at the technical face.

The pile yarns and the backing or stitch yarns can all be formed of the same polymer, for example, 100% polyester. Contrasting technical face to technical back appearance is obtained by selecting the pile yarns and by selecting the backing or stitch yarns to have different physical properties, e.g. different cross-sections, denier and/or surface textures. The different properties of the yarns cause the yarns to respond differently to processing, e.g., dyeing, heat-treating and/or napping operations.

The backing or stitch yarns and the pile yarns are selected to provide the fabric with a technical face having a first set of appearance characteristics and a technical back having a contrasting second set of appearance characteristics. Each set of appearance characteristics may be selected from among the following: depth of color upon dyeing, degree of raising, degree of air permeability, susceptibility to selected dye formulation, reaction to heat, and degree of coarseness, bulk and/or denier.

For example, the pile yarns may include one or more of the following:

(1) 212/94 FF, T-659 serrated ribbon cross-section yarn, which will remain straight after dyeing.

(2) 200/100 FF, T-840 Hoy yarn, trilobal cross section, which will dye to a relatively darker hue and which will curl with application of heat, e.g. after dyeing.

(3) 2/70/200 tx, textured yarn, which will dye relatively lighter and which will shrink with application of heat, e.g. during dyeing.

(4) 150/68 tx, textured yarn, which will shrink and crimp with application of heat, e.g. during dyeing.

The fabric may be formed with a single type of pile yarn selected from the yarns described above, or two or more of these pile yarns may be combined in a pattern of regions.

The yarn forming the technical face may be selected from the following examples of polyester yarns:

(1) 4/70/200 tx, textured micro denier yarns. This type of yarn with any of the above pile yarns will be dyed to a significantly lighter hue. It will be raised to very low pile height (because it is a very fine micro denier), e.g., the fine denier polyester may be raised and sheared very low to get chamois/suede touch. This fabric with very low velour can be tumbled to accentuate the coarseness of the Raschel warp knitting machine 16 gauge. The micro denier fibers will also contribute significantly to providing a relatively low air permeability, e.g., at 35 to 60 CFM, under 0.5 inch of water pressure drop.

(2) 2/150/132 tx, textured polyester. This fabric will dye relatively lighter than the pile yarn. The fibers will be drawn low during the raising process, but the fabric will not have a very low permeability, e.g., at 90 to 120 CFM, the permeability will not be under 0.5 inch of water pressure drop.

(3) 300/512 tx polyester. The air permeability of this fabric will be somewhere between that of the fabric of example (1) and that of the fabric of example (2), e.g., under 0.5 inch of water pressure drop at about 75 CFM.

(4) two ends of 2/70/1968 commingled yarn of dispersion dyeable polyester and cationic dyeable polyester. Following the dyeing process with two different groups of dyestuff (i.e. dispersion and cationic), the fabric will have a heather look.

The technical face and back of the fabric can also be finished in different ways to achieve different aesthetic or technical properties. For example, based on the selection of the backing or stitch yarns used for the technical face, the fabric, after dyeing, will consolidate well to allow a broad range of air permeability.

The yarns may also be selected to give different surface textures on the technical face and the technical back.

For example, using stitch yarns with 100/34 tex, pile yarns with 150/68 tex round cross section, and a tenacity of 4.5 gpd, and backing yarns with 2/150/450 tex and a dyeing cycle at 265° F. provides a technical back surface with tight twisted curls. Changing the interconnecting pile yarns to yarns with 200/100 tex, a trilobal cross-section, and tenacity of 3 gpd, forms a technical back surface with a large shearl. In another example, changing the pile yarns to yarns with 212/94 tex and flat, serrated rectangular cross section forms a technical back surface with straight pile.

In addition to using one type of backing or stitch yarns to create a fabric with one type of surface, contrasting types of backing or stitch yarns can be used in a single fabric to create regions with different appearance characteristics on the technical face surface.

For example, a fabric may include a band of backing yarns with 200/100 tex, a trilobal cross section and tenacity of 3 gpd, and bands of backing yarns with 212/94 tex and a flat, serrated cross section. The resulting fabric has a technical face surface with stripes of shearl and stripes of straight pile. Other patterns can also be created, e.g., squares, rectangles, argyle, etc. Moreover, different textures can be used in a variety of patterns.

Preferably, the fabrics are dyed in a jet-dyeing machine, i.e., a textile dyeing process that directs streams of dyeing liquid at a textile to provide deep penetration of the dye material into the fibers of the fabric. The dyeing liquid is prepared using one or more suitable dyestuffs, e.g., using conventional methods. Dyestuffs include direct dyes, reactive dyes and sulphur dyes. The liquid to goods ratio may be varied as desired. The process typically involves circulation of a rope of fabric through a dye bath under the influence of a rapidly moving jetted portion of the liquid dye bath. Jet dyeing allows the dye to be brought into contact with the fabric under selected temperature and pressure conditions. In one embodiment, the jets strike the rope of fabric at an angle of 45° or greater and a temperature of about 265° F. The kinetic energy of the jet forces the dye into the fabric fibers and circulates the rope of fabric through the dye bath. The kinetic energy of the jets also serves to loosen the backing and stitch yarn fibers.

Figure 7:
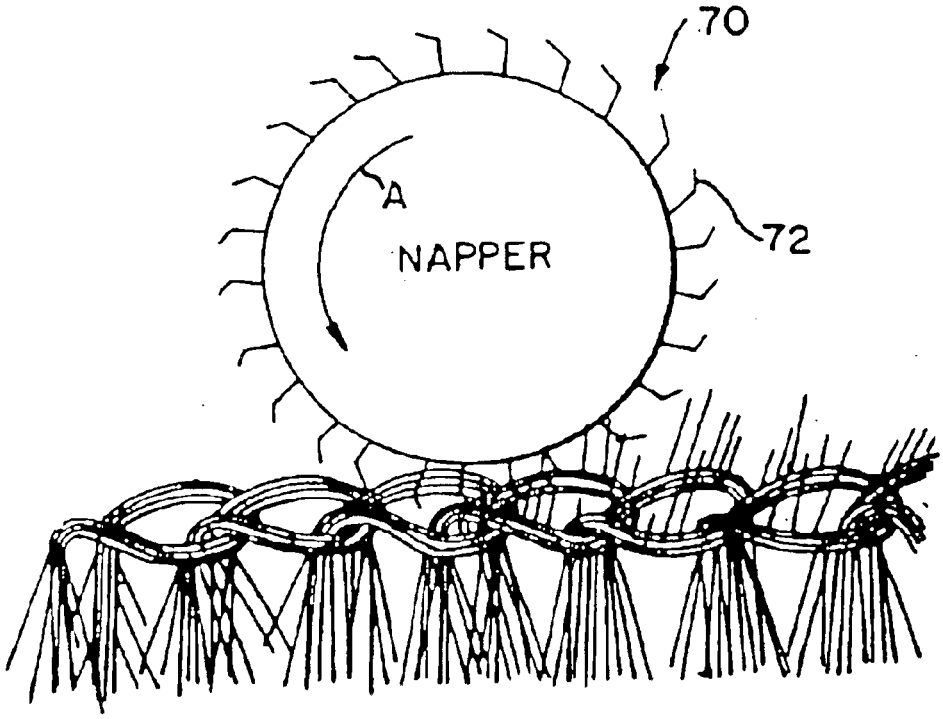
FIG. 7 shows a somewhat schematic side view of a napping process.

The technical face of the jet dyed fabric is then napped to create the finished velour surface of the fabric, as discussed above. Referring to FIG. 7, a fabric is shown being napped by a napper, graphically represented by a cylinder 70. The cylinder 70 is rotating in the direction indicated by arrow A and is provided with a plurality of angled wire fingers 72. Since the backing or stitch yarns are at least as bulky and thick as the pile yarn, the wire fingers 72 mainly catch the backing or stitch yarns, and miss the pile yarns. As a result of the napping, a certain percentage of the fibers of the backing or stitch yarns are physically pulled out of the substrate. The free ends of the fibers of backing or stitch yarns extend in the same direction away from and along the technical face while the pile yarn fibers remain on the technical back of the fabric. The percentage of the fibers pulled out of the substrate is dependent on a number of factors, such as napper speed and tension and the speed and tension of the fabric. Thus, this percentage may be adjusted by adjusting these napping parameters so that enough fibers of the backing and stitch yarns are pulled out to create a desired surface texture but not so much as to weaken the fabric's strength.

In some implementations, the technical face of the fabric may be coated or impregnated with a coating or binder to provide desired technical and/or aesthetic properties. For example, the technical face may be coated with acrylic latex, silicone or polyurethane to improve abrasion resistance and reduce pilling. Abrasion resistance may be tested using modified Martindale abrasion testing in which a patch of VELCRO® hook material is rubbed against the technical face.

The coating or binder may be applied to the technical face in a pattern or design that will resist raising during the napping process, to provide the finished technical face with a pattern of raised and non-raised areas, e.g., in an aesthetically appealing design.

The fabric can also be printed, e.g., with a wet printing process, to impart a desired colored pattern or design to the technical face.

A number of embodiments of the invention have been described. Nevertheless, it will be understood that various modifications may be made without departing from the scope of the invention. For example, the arrangement shown in FIG. 1 is just one example of an arrangement that can be used to obtain a fabric with a velvet finish pattern on one side and a velour finish pattern on the other side. Other arrangements may be used. For instance, the fabric can be made either more elastic or more dimensionally stable by increasing or decreasing lap movement of guide bars 1, 2, 6 and 7. Moreover, while combinations of polyester yarns are discussed above, other synthetic yarns and/or natural yarns can be used as the pile and/or stitch and/or backing yarns.

Accordingly, other embodiments are within the scope of the following claims.

What is claimed is:

1. A method of making a fabric on a double bar knitting machine, with the fabric having a technical face with a velour surface and a first set of appearance characteristics, and the fabric having an opposite, technical back with a velvet surface and a second set of appearance characteristics, the first set of appearance characteristics of the technical face contrasting to the second set of appearance characteristics of the technical back, said method comprising the steps of:

selecting backing or stitch yarns and selecting pile yarns to provide the fabric with the technical face having the first set of appearance characteristics and the technical back having the contrasting second set of appearance characteristics, the first set of appearance characteristics of the technical face selected from among: depth of color upon dyeing, degree of raising, degree of air permeability, susceptibility to selected dye formulation, reaction to heat, and degree of coarseness, bulk and/or denier; and the second set of contrasting appearance characteristics selected from among: depth of color upon dyeing, degree of fiber straightness, degree of fiber curl, degree of fiber shrinkage, degree of fiber crimp degree of raising, reaction to heat, degree of yarn coarseness, bulk and/or denier;

knitting a three-dimensional fabric structure on the knitting machine, said structure having two fabric substrates formed from the backing and stitch yarns, each defining a technical face and a technical back, and a plurality of the pile yarns extending between and interconnecting the fabric substrates;

during knitting, causing the backing yarns or the stitch yarns to cover the pile yarns at the technical face of each fabric substrate;

cutting the pile yarns to separate the fabric substrates, with ends of the pile yarns extending from the technical back of each fabric substrate;

dyeing the fabric substrate;

processing the backing yarns or the stitch yarns covering the pile yarns at the technical face of the fabric substrate to form the velour surface; and processing the pile yarns at the technical back of the fabric substrate to form the velvet surface.

2. The method of making a fabric of claim 1, wherein the step of dyeing the fabric comprises dyeing to a solid color, and the step of selecting the yarns comprises selecting the yarns to have different dyeabilities and/or dye uptakes.

3. The method of making a fabric of claim 1 or 2, wherein the step of dyeing the fabric substrate comprises:

dyeing the backing yarns or stitch yarns exposed at the technical face to have a first base color and a first depth of color, and dyeing the pile yarns exposed at the technical back to have a first base color and a second depth of color, said first depth of color being in contrast to said second depth of color.

4. The method of making a fabric of claim 3, wherein the step of selecting the first set of appearance characteristics and selecting the contrasting second set of appearance characteristics comprises selecting the depth of color upon dyeing, with the first depth of color selected to be relatively lighter than the second depth of color.

5. The method of making a fabric of claim 3, wherein the step of selecting the first set of appearance characteristics and selecting the contrasting second set of appearance characteristics comprises selecting the depth of color upon dyeing, with the first depth of color selected to be relatively darker than the second depth of color.

6. The method of making a fabric of claim 4, wherein the step of selecting the first set of appearance characteristics and selecting the contrasting second set of appearance characteristics comprises selecting a first dye for the backing or stitch yarns and selecting a second, different dye for the pile yarns.

7. The method of making a fabric of claim 4, wherein the step of selecting the first set of appearance characteristics and selecting the contrasting second set of appearance characteristics comprises selecting a first material for the backing or stitch yarns and selecting a second material for the pile yarns.

8. The method of making a fabric of claim 7, wherein the step of selecting the backing or stitch yarns and selecting the pile yarns comprises selecting the first material and the second material to be 100% polyester.

9. The method of making a fabric of claim 5, wherein the step of selecting the first set of appearance characteristics and selecting the contrasting second set of appearance characteristics comprises selecting a first dye for the backing or stitch yarns and selecting a second, different dye for the pile yarns.

10. The method of making a fabric of claim 5, wherein the step of selecting the first set of appearance characteristics and selecting the contrasting second set of appearance characteristics comprises selecting a first material for the backing or stitch yarns and selecting a second material for the pile yarns.

11. The method of making a fabric of claim 9, wherein the step of selecting the backing or stitch yarns and selecting the pile yarns comprises selecting the first material and the second material to be 100% polyester.

12. The method of making a fabric of claim 1, wherein the step of selecting the pile yarns comprises selecting first pile yarns having first appearance characteristics and selecting second pile yarns having second appearance characteristics different from the first appearance characteristics, and the step of knitting comprises disposing the pile yarns in a predetermined pattern comprising one or more regions of the first pile yarns having the first appearance characteristics and one or more regions of the second pile yarns having the second appearance characteristics different from the first appearance characteristics.

13. The method of making a fabric of claim 1, wherein the step of processing the pile yarns comprises causing the velvet surface to have a depth in the range of about $^{2}/_{32}$-inch to about $^{18}/_{32}$-inch.

14. The method of claim 1, comprising the further step of dyeing one or more regions of the backing or stitch yarns at the technical face through by application of dye of contrasting color by wet printing techniques.

15. The method of claim 1, comprising the further step of applying a chemical binder upon one or more regions of the backing or stitch yarns at the technical face to create regions of enhanced surface abrasion resistance.

16. The method of claim 1, comprising the further step of applying a chemical resist upon one or more regions of the backing or stitch yarns of the technical face prior to the step of processing, for local resistance to napping and raising, thereby to create a predetermined pattern of regions of low or no fleece among adjacent regions of high fleece in the velour surface of the technical face.

17. A fabric comprising a plurality of backing or stitch yarns cooperatively knitted together and thereby defining a technical face with a velour surface and a first set of appearance characteristics and a technical back with a velvet face and a second set of appearance characteristics, said first set of appearance characteristics contrasting with said second set of appearance characteristics; and a plurality of pile yarns extending from said technical back and being napped or raised, thereby forming the velvet surface at said technical back; and said backing or stitch yarns covering said technical face and being napped or raised, thereby forming the velour surface at said technical face, said backing or stitch yarns covering said pile yarns along said technical face in a manner such that only said backing or stitch yarns are raised along said technical face;

said backing or stitch yarns being formed of materials having said first set of appearance characteristics selected from the group of appearance characteristics consisting of: depth of color upon dyeing, degree of raising, degree of air permeability, susceptibility to selected dye formulation, reaction to heat, and degree of coarseness, bulk and/or denier; and said pile yarns being formed of materials having said second set of appearance characteristics selected from among the group of appearance characteristics consisting of: depth of color upon dyeing, degree of fiber straightness, degree of fiber curl, degree of fiber shrinkage, degree of fiber crimp degree of raising, reaction to heat, degree of yarn coarseness, bulk and/or denier.

18. The fabric of claim 17 wherein said backing or stitch yarns covering said pile yarns on said technical face have a first cross-section and said pile yarns have a second, different cross-section.

19. The fabric of claim 18 wherein said pile yarns have a cross-section selected from the group consisting of serrated ribbon and trilobal.

20. The fabric of claim 17 wherein said backing or stitch yarns coveting said pile yarns on said technical face have a first denier and said pile yarns have a second, different denier.

21. The fabric of claim 17 wherein said technical back and said technical face are of the same hue.

22. The fabric of claim 17, wherein said technical back and said technical face have contrasting surface textures.

23. The fabric of claim 22 wherein said technical back has a raised pile surface and said technical face has a sheared chamois or suede surface.

24. The fabric of claim 17 wherein said velvet surface of said technical back and said velour surface of said technical face have contrasting pile heights.

25. The fabric of claim 24 wherein said velvet surface of said technical back has a pile height in the range of about 0.06 inch to about 0.6 inch, and said velour surface of said technical face has a significantly lower pile height than said velvet surface of said technical back.

26. The fabric of claim 17 wherein said backing or stitch yarns covering said pile yarns at said technical face comprise microdenier yarns.

27. The fabric of claim 17 wherein said fabric is jet-dyed.

28. The fabric of claim 17 wherein said pile yarns comprise polyester.

29. The fabric of claim 17 or 28 wherein said backing or stitch yarns cover said pile yarns at said technical face comprise polyester.

30. The fabric of claim 17 wherein said pile yarns and said backing or stitch yarns comprise 100% polyester yarns.

31. The fabric of claim 17, wherein one or more regions of said velour surface at said technical face have color contrasting to a surrounding region by application of dye by wet printing techniques.

32. The fabric of claim 17, wherein one or more regions of said backing or stitch yarns at said technical face have enhanced surface abrasion resistance by application of chemical binder.

33. The fabric of claim 17, wherein said technical face defines a predetermined pattern of regions of low or no fleece among adjacent regions of high fleece in said velour surface, achieved by application of a chemical resist upon regions of said backing or stitch yarns of said technical face prior to processing, for local resistance to napping and raising.

* * * * *

UNITED STATES PATENT AND TRADEMARK OFFICE

CERTIFICATE OF CORRECTION

PATENT NO. : 6,832,497 B1 
DATED : December 21, 2004
INVENTOR(S) : Moshe Rock, Gadalia Vainer and Charles Haryslak It is certified that error appears in the above-identified patent and that said Letters Patent is hereby corrected as shown below:

Column 11,
Line 13, after "yarns", replace "coveting" with -- covering --.

Signed and Sealed this

Seventh Day of June, 2005

JON W. DUDAS
*Director of the United States Patent and Trademark Office*